United States Patent [19]

Vandenhoeck

[11] 4,237,962

[45] Dec. 9, 1980

[54] SELF-CLEANING HEAT EXCHANGER

[76] Inventor: J. Paul Vandenhoeck, c/o The Econo-Therm Corporation P.O. Box 309, Englewood, N.J. 07631

[21] Appl. No.: 932,800

[22] Filed: Aug. 11, 1978

[51] Int. Cl.[3] ..... F28G 13/00; B08B 9/02

[52] U.S. Cl. ..... 165/1; 15/3.51; 134/7; 134/8; 165/95

[58] Field of Search ..... 165/1, 95; 134/7, 8, 134/22 C, 166 C, 168 C; 15/3.5, 3.51, 3.52, 104.05

[56] References Cited

U.S. PATENT DOCUMENTS

| | | | |
|---|---|---|---|
| 1,581,545 | 4/1926 | Prache | 165/95 X |
| 1,795,348 | 3/1931 | Schmidt | 165/95 |
| 1,871,166 | 8/1932 | Fahrbach | 165/5 |
| 1,939,112 | 12/1933 | Eulberg | 165/95 X |
| 2,670,723 | 3/1954 | Clarkson | 165/95 X |
| 2,721,626 | 10/1955 | Rick | 134/7 X |
| 2,745,231 | 5/1956 | Prince | 51/282 |
| 2,801,824 | 8/1957 | Taprogge | 165/95 X |
| 2,949,282 | 8/1960 | Kirkby | 165/95 |
| 3,021,117 | 2/1962 | Taprogge | 165/95 |
| 3,033,711 | 5/1962 | Harding | 134/7 |
| 3,062,508 | 11/1962 | Braddon | 165/95 |
| 3,073,688 | 1/1963 | McCune | 51/317 |
| 3,082,073 | 3/1963 | McAnneny | 134/7 X |
| 3,139,711 | 7/1964 | Soderberg, Jr. | 51/317 |
| 3,215,195 | 11/1965 | Treplin | 165/95 |
| 3,302,699 | 2/1967 | Hedentorp et al. | 165/95 |
| 3,507,319 | 4/1970 | Kogan | 165/95 |
| 3,854,997 | 12/1974 | Peck et al. | 134/7 |
| 3,882,931 | 5/1975 | Kumagi | 165/95 |

*Primary Examiner*—Stephen Marcus

*Attorney, Agent, or Firm*—Lerner, David, Littenberg & Samuel

[57] ABSTRACT

A method and apparatus for cleaning a heat exchanger during operation thereof. The heat exchanger includes a plurality of tubes through which a first fluid is conducted from an inlet end to an outlet end in indirect heat transfer relationship with a second fluid disposed on the outside of the tubes intermediate the inlet and outlet ends of the tubes. Further, the heat exchanger includes an inlet chamber for the first fluid communicating with the inlet ends of the tubes, and a tube sheet for supporting the inlet ends of the tubes and isolating the inlet chamber from the second fluid, the inlet ends of the tubes extending into the inlet chamber beyond the tube sheet. The method of cleaning comprises introducing a particulate cleaning media between the inlet ends of the tubes and the tube sheet, and then forcing the introduced particulate cleaning media in a direction counter to the direction of flow of the first fluid through the tubes along the exterior surfaces of the tubes to the inlet ends of the tubes so that the particulate cleaning media is introduced into the tubes and is directed against the inner walls thereof as the flow of particulate cleaning media is changed so that it flows through the tubes in the direction of the flow of the first fluid. Apparatus is also disclosed for cleaning of a heat exchanger in accordance with this method.

14 Claims, 4 Drawing Figures

SELF-CLEANING HEAT EXCHANGER

BACKGROUND OF THE INVENTION

The present invention relates to a method and apparatus for self-cleaning of heat exchangers of the shell-tube type in which transfer of heat is effected between two media, one of the media being conveyed through sets of tubes connected in parallel and the other media passing through the space between the tubes. More particularly, the present invention relates to a method and apparatus for cleaning the inner walls of the tubes of such shell-tube type heat exchangers.

As is well known to persons skilled in the art, the efficiency of a heat exchanger of the shell-tube type is unavoidably lessened after some time of operation due to deposits on the tube walls, especially to deposits along the inner tube walls. Such deposits may be caused by mechanical impurities carried by the media flowing through the tubes which condense along the tube walls or by substances contained in the media in a state of solution but percipitated therefrom by thermal and/or chemical influences. These deposits impede the heat transition to transfer through the tube walls and thereby deteriorate the efficiency of the heat exchanger. When this efficiency is lowered to a certain fraction of the original efficiency thereof, the tubes have to be cleaned mechanically and/or chemically to restore the original efficiency. As can be appreciated, having to take the heat exchanger out of operation to accomplish this cleaning necessarily lessens the economic efficiency of the apparatus in which the heat exchanger is employed, and thus tends to increase the cost of operation of the unit.

It is desirable in many instances to recover and utilize for a useful purpose hot gases generated by combustion or other plant operation which might otherwise simply be exhausted to the atmosphere. For example, in foundry operations, significant amounts of heat are generated in the melting furnace or cupola. It has been found that this heat can be used effectively and for a useful purpose as for instance, in heating a second fluid, such as water which may then be utilized for space heating of the plant. Normally, the hot gases generated in the furnace are directed through air pollution and filtering systems for removing entrained ash, molten slag or other condensable fumes which necessarily results in a cooling of the gases such that it is often not possible to utilize efficiently such gases in a heat exchanger. Accordingly, it has been found desirable to pass the hot dirty gases through a heat exchanger prior to conduction through air pollution and environmental filtering systems. However, passing of such dirty gases through tubes in a shell-tube type heat exchanger has generally been found to result in significant condensation of the condensable fumes and accumulation to the entrained ash and molten slag on the inner surfaces of the tubes which, as noted above, reduces the heat transfer efficiency of the heat exchanger.

Because it is desirable to pass the hot dirty gases through the tubes prior to air pollution environmental filtering systems, the amount of accumulation of deposits on the inner tube walls is necessarily amplified and greatly increased over accumulations found in other applications which use relatively clean gases. Thus, to provide for efficient operation of the plant and in particular of the heat exchanger in which hot dirty gases pass, it is found preferable to provide some means for self-cleaning of such heat exchangers, either continuously during operation, or intermittently, without necessitating a shut down of the heat exchanger. In the past, to clean such heavy deposits on the inner tube walls, it has been suggested that particulate cleaning media or matter be introduced into the inlet chamber for the tubes and to then flow through the tubes to scour the inner walls to remove the accumulation of slag and/or condensed metal fumes.

However, introduction of such particulate cleaning matter in the inlet chamber causes such particles to become entrained in the hot dirty gases which flow at high speeds through the tubes. This results in the major portion of the entrained particles flowing through the central portion of the tubes because of the flow velocity distribution of the gases through the tubes. Further, to the extent that any of the particulate cleaning matter is directed against the inner walls of the tubes, such particles flow at too high of a velocity which thereby creates erosion of the tube surfaces with a consequent wearing out or through of the tubes. Thus, use of particulate cleaning particles in the past has not proved efficient for cleaning of the inner tube walls in heat recovery systems which utilize the flow of hot dirty gases through the tubes of a shell-tube type heat exchanger.

SUMMARY OF THE INVENTION

These and other disadvantages of the prior art are overcome with the method and apparatus of the present invention which is directed to cleaning of a heat exchanger during operation in which the heat exchanger has a plurality of tubes through which a first fluid is conducted from an inlet end to an outlet end in indirect heat transfer relationship with a second media disposed on the outside of the tubes intermediate the inlet and outlet ends of the tubes, and in which the heat exchanger further includes an inlet chamber for the first fluid communicating with the inlet ends of the tubes, and a tube sheet for supporting the inlet ends of the tubes and for isolating the first fluid in the inlet chamber from the second heat transfer media, the inlet ends of the tubes extending into the inlet chamber beyond the tube sheet. According to the method of the present invention, a particulate cleaning medium is introduced between the inlet ends of the tubes and the tube sheet and is then forced in a direction counter to the direction of flow of the first fluid through the tubes along the exterior surfaces of the tubes to the inlet ends of the tubes so that the particulate cleaning matter is introduced into the tubes and is directed against the inner walls of the tubes as the direction of flow is changed so that the particulate cleaning media flows through the tubes in the direction of the flow of the first fluid. In this way, the particulate cleaning media does not become entrained in the flow of the first fluid through the tubes, but is rather pulled along the inner walls of the tubes at a much slower velocity to result in an efficient cleaning of the tubes without causing erosion of the tube surfaces.

According to the apparatus of the present invention, in the shell-tube type heat exchanger, means are provided for distributing the particulate cleaning media between the inlet ends of the tubes and the tube sheet and for forcing the particulate cleaning media along the exterior surfaces of the tubes to the inlet ends of the tubes in a direction counter to the direction of flow of the fluid through the tubes so that the particulate cleaning media is introduced into the tubes and is directed against the inner walls of the tubes as its direction of flow is changed and it moves in the direction of flow of the fluid through the tubes.

Preferably, the inlet ends of the tubes are arranged at an elevation above the outlet ends of the tubes, and the tube sheet is positioned below the inlet ends of the tubes. In this way, the distributing means for the particulate forces the particulate cleaning media upwardly along the exterior surfaces of the tube to the inlet ends of the tubes, and then gravity pulls the particulate matter downwardly along the inner tube walls. The fluid flow through the tubes forces the particulate matter which falls into the tubes against the side inner walls of the tubes. Yet, the particulate matter, in being directed to an elevation just above the inlet ends of the tubes, does not become entrained in the fluid flow through the tubes which might otherwise deleteriously affect the efficient cleaning action of the particulate matter along the inner tube walls which has been a problem of the prior art.

In a further preferred embodiment, the inlet ends of the tubes are funnel shaped having a tapered open end tapering to a narrow inner diameter of the tubes. Such an arrangement is advantageous to cause the particulate cleaning media when introduced into the tubes to be directed against the inner walls of the tubes upon downward movement of the particulate cleaning matter through the tubes.

These and other features and characteristics of the present invention will be apparent from the following detailed description in which reference is made to the enclosed drawings which illustrate a preferred embodiment of the present invention.

DETAILED DESCRIPTION OF THE INVENTION

Figure 1:
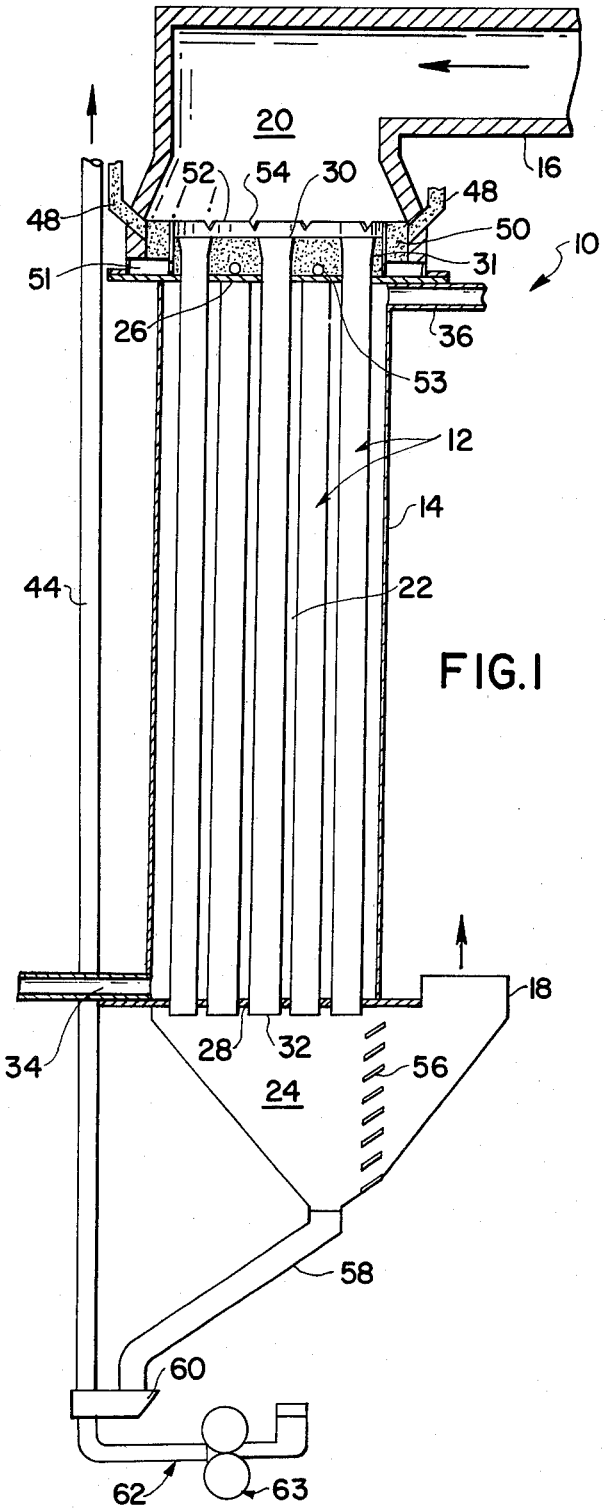
FIG. 1 is a schematic side elevational view of the self-cleaning heat exchange apparatus in accordance with the present invention.

Referring now to the drawings in which like reference numerals represent like components, there is shown in FIG. 1 a self-cleaning heat exchanger 10 constructed in accordance with the present invention. The heat exchanger 10 is generally of the shell-tube type in which there are a plurality of generally parallel tubes 12 for a first fluid which is adapted to flow therethrough in indirect heat transfer relationship with respect to a second heat transfer media arranged on the outer surfaces of such tubes. In particular, the self-cleaning heat exchanger 10 of the present invention is adapted to receive the hot dirty gases generated in a industrial plant, such as a foundry furnace or cupola, and to recover and utilize for a useful purpose the heat contained in such gases. In such a system, the hot dirty gases generated in the industrial plant comprise the first fluid which is adapted to flow through the tubes 12. The second heat transfer medium is conducted along or around the outer surfaces of such tubes 12 intermediate the ends thereof to receive, by indirect heat transfer through the walls of the tubes 12, at least a portion of the heat contained in the gases. This second heat transfer medium may comprise a gas, a liquid, or even solid particulate, such as in the form of pebbles, etc., which, when coming in contact with the outer surfaces of the tubes, receive a portion of the heat of the hot gases flowing therethrough. Of course, it is to be understood that while the present invention will be described with reference to such a system wherein hot dirty gases generated in an industrial plant comprise the first fluid flowing through the tubes, the heat exchange apparatus 10 of the present invention may also be used in connection with other types of systems and is not meant to be limited solely for use in industrial plants and the like.

As best seen in FIG. 1, the heat exchanger 10 comprises a generally vertically oriented, cylindrically shaped vessel 14 having an inlet conduit 16 at its upper end and an outlet conduit 18 at its lower end. Inside the vessel 14, the heat exchanger 10 includes an inlet chamber or plenum 20 communicating with the inlet conduit 16 for receiving the hot dirty gases, heat transfer section or plenum 22 in which the heat of the hot dirty gases is transferred to the secondary heat transfer media, and an outlet chamber or plenum 24 communicating with the outlet conduit 18 for receiving the cooled, dirty gases after they have given up a portion of their heat in the heat transfer plenum 22. The three plenums are defined and separated by upper and lower tube sheets 26, 28 which support the upper inlet and lower outer ends 30, 32 of the plurality of tubes 12 respectively. That is, the upper tube sheet 26 serves to support the upper or inlet ends 30 of the tubes 12 and to isolate the inlet chamber 20 receiving the hot gases from the secondary heat transfer media whereas the lower tube sheet 28 serves to support the lower outlet ends 32 of the tubes 12 and to isolate the outlet chamber 24 receiving the cooled gases from the secondary heat transfer media. The heat transfer plenum or section 22 in which the secondary heat transfer media circulate is thus defined between the upper and lower tube sheets 26, 28.

The hot dirty gases generated in the plant are conducted into the inlet chamber 20 above the inlet ends 30 of the tubes 12 and then flow downwardly through the tubes 12. As the gases pass downwardly inside the tubes 12 through the heat transfer plenum 24, some of the heat of the gases is given up to the secondary heat transfer media. After passing through the heat transfer plenum 24, the cooled gas then flows downwardly into the outlet chamber 24. From the outlet chamber 24, the cooled dirty gases are conducted through the outlet conduit 18 to air pollution control equipment and an exhaust fan (not shown). The exhaust fan serves as a driving force for conduction of the gases through the heat exchanger.

In the preferred embodiment, the secondary heat transfer media comprises water which is adapted to be heated by the hot gases and to serve as a heating media for space heaters arranged throughout the foundry or other type of industrial plant. The secondary water is introduced into the heat transfer chamber 22 through a secondary inlet conduit 34. The water is then circulated across the tube surfaces picking up the heat given up by the gases and conducted upwardly to a secondary outlet conduit 36. From there, the heated water is then conducted to a suitable space heating system for heating of the plant.

For certain types of foundry operations, the air pollution control equipment is necessary for environmental purposes in order to remove entrained ash particles, slag, condensable metal fumes, etc. before exhausting the gases into the atmosphere. As noted herein above, it is desirable to first pass the hot dirty gases from the cupola through the heat exchanger 10 before passing such gases through the air pollution control equipment as such filtering equipment also tends to remove the heat contained in the gases. On the other hand, as can be appreciated, the entrained ash, molten slag, condensable metal fumes, etc. in the gases tend to accumulate on the heat transfer tubes if it is first passed through the heat exchanger. This causes fouling of the heat transfer tubes and thus a loss in thermal transfer efficiency. Consequently, such fouling of the heat transfer surfaces tends to reduce the efficiency of the heat exchanger and thus results in a higher cost for operation of the plant.

Prior art systems have suggested the use of utilizing self-cleaning heat exchangers which are capable of cleaning the tube surfaces on a continuous basis or intermittently during operation of the plant. For example, such prior art systems have suggested the use of particulate cleaning or scouring media in the form of sand, limestone, steel shot, etc. which flow through the tubes along with the hot dirty gases. The function of the scouring media is to clean and scour the inside tube surfaces to prevent a significant build up of dust particulate and condensable fumes on the tube surfaces.

In the prior art systems, such scouring media was introduced in the inlet chamber above the inlet tube ends to become entrained with the dirty gases and then to flow downwardly through the tubes therewith. However, because of entrainment in the gases which flow through the tubes at a high velocity, there is a tendency, because of the flow velocity distribution through the tubes to be bell shaped, for the particles to be directed inwardly towards the center of the tubes and thereby not perform any scouring of the tube surfaces. This is especially true with lighter cleaning particulate matter. On the other hand, if heavier particulate matter is utilized so that the particulate matter would move along the inner tube surfaces, the scouring media tended to move along the tube surfaces at high velocity. This has resulted in erosion, with the consequent wearing out or through of the tubes, because of the high velocity and the abrasive characteristics of the scouring media. As can be appreciated, such is entirely unacceptable since it necessitates the removal of the heat exchanger from operation in order to repair the tubes.

The present invention however, overcomes these disadvantages by first distributing particulate cleaning matter in the inlet chamber 20 for the hot dirty gases on the upper tube sheet 26 below the tube inlet ends 30 and then forcing such particulate cleaning matter 42 upwardly along the outer surfaces 38 of the tubes 12 to the inlet ends 30 of the tubes 12 in a direction counter to the direction of flow of the dirty gases. At the tube inlet ends 30, the particulate cleaning matter 42 is allowed to fall into the tubes 12 and flow downwardly along the inside surfaces 40 by the force of gravity to clean and scour such surfaces 40. Because the particulate cleaning matter 42 is initially directed in counter flow to the hot dirty gases, such particulate matter 42 does not easily become entrained in such gases and therefore the problems experienced by the prior art are not encountered. That is, because the particles 42 when they are introduced into the tubes 12 are not entrained in the first heat transfer fluid (i.e., the hot dirty gases), the particulate matter 42 is not conducted downwardly along the tube surfaces 40 at a relatively high velocity, nor are they directed inwardly toward the center of the tubes 12. Instead, the particulate cleaning matter 42 is directed outwardly against the inner tube walls 40 upon the introduction into the tubes 12, and in essence is dragged along by the gases flowing therethrough and/or by gravity. Because of this action, the particles 42 move at a much slower velocity along the inner tube surfaces 40 and effectively serve to scour and clean such tube surfaces 40 without such a highly abrasive and destructive quality as was experienced by the high velocity flowing particles of the prior art.

The particulate cleaning matter or media 42 contemplated by the present invention includes sand, steel shot, aluminum particles, limestone and similar type granular or coarse particles. Preferably, the particles have a size ranging between 100 and 1,000 microns. Further, it is to be noted that limestone particles also serve to provide a chemical reaction in certain instances to prevent acid build up on the tube surfaces 40.

Figure 2:
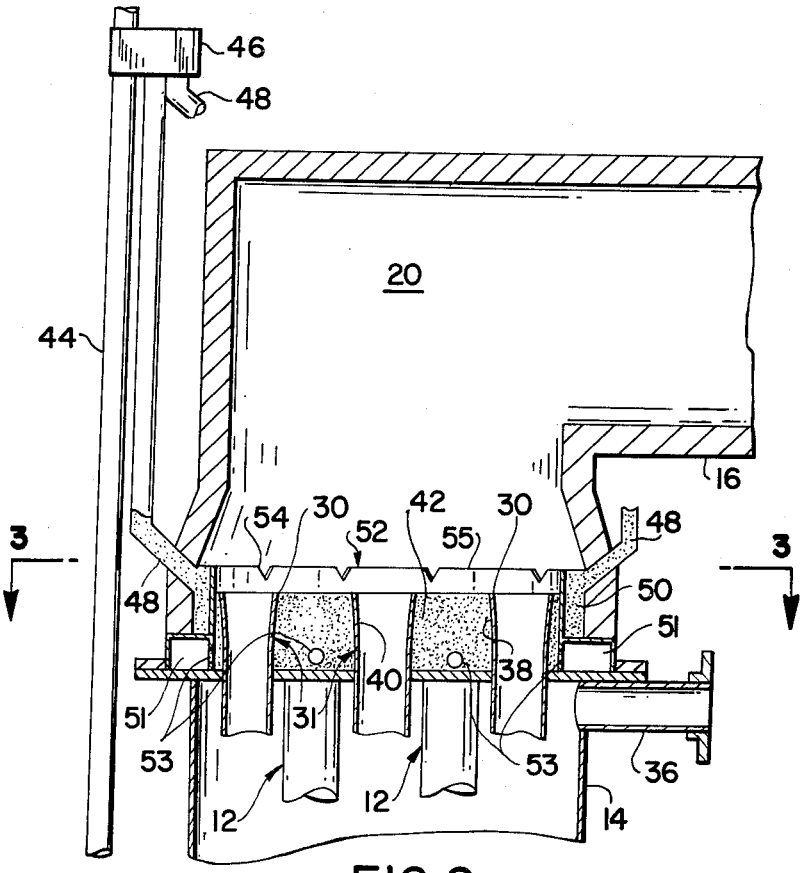
FIG. 2 is an enlarged side elevational view, partly in section, of the upper end of the self-cleaning heat exchange apparatus of the present invention.
Figure 3:
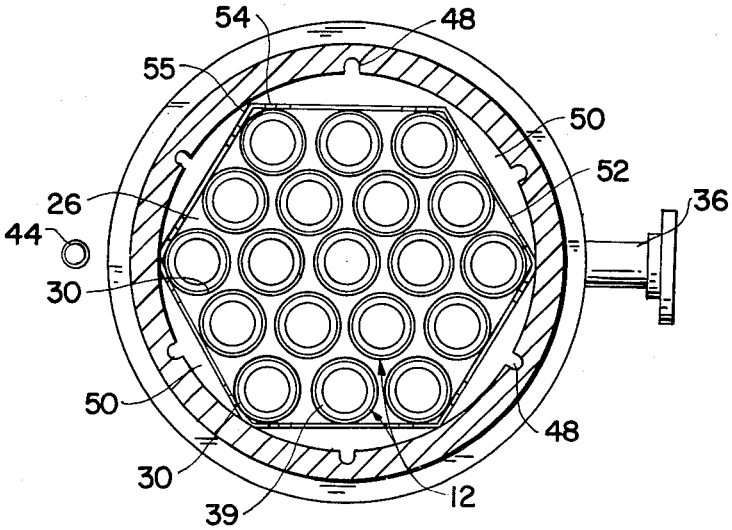
FIG. 3 is a top sectional view of the inlet chamber of the self-cleaning heat exchange apparatus of the present invention taken along lines 3—3 of FIG. 2.

More particularly, according to the present invention, scouring or particulate cleaning media 42 is initially pumped or transported upwardly to an elevation above the upper tube sheet 26 supporting the upper ends 31 of the tubes 12 of the heat exchanger 10. This may be accomplished by means of a pneumatic lifting media such as air which forces the dense particles 42 upwardly inside a tube or pipe 44 to an external distribution chamber 46 located at the exterior of the heat exchanger 10. At the distribution chamber 46, the particulate material 42, for example, sand particles, is allowed to flow downwardly through a series of secondary conduits 48 spaced about the periphery of the heat exchanger 10 to an internal segmented distribution chamber 50 arranged about the inner periphery of the heat exchanger 10 and slightly spaced about the upper tube sheet 26. As best seen in FIGS. 2 and 3, there are six secondary conduits 48 which allow the sand to flow into a segmented inner distribution chamber 50 defined by the inner walls of the heat exchanger vessel 14 and a distribution ring 52 extending upwardly from the upper tube sheet 26 and surrounding all of the tubes 12.

In the preferred embodiment, the distribution ring 52 extends above the inlet ends 30 of the tubes 12 and is provided with a plurality of V-shaped channels 54 at the upper edge 55 thereof. In essence, the V-shaped channels 54 serve as a weir for the particulate cleaning media introduced into the inner distribution chamber 50. As the particulate matter is introduced into the segmented chamber 50, the level or elevation thereof rises and the particulate sand 42 flows through the V-shaped openings 54 onto the tube sheet 26 and is distributed inwardly around the bases of the tube ends 31 extending upwardly above the tube sheet 26. That is, as more particulate sand 42 flows through the opening 54 and onto the tube sheet 26, the sand will be directed and distributed inwardly toward the central most tubes 12. As can be appreciated, the greater the number of tubes 12 there are and thus the greater the area occupied inside of the distribution ring 52, it may be necessary to increase the height of the tube ends 31 above the tube sheet 26 in order to have the sand or other particulate matter flow inwardly to the central most tubes 12.

After the sand or other particulate matter has been delivered onto the tube sheet 26 and has been roughly distributed about the tubes 12 by means of the V-shaped weir openings 54, further finer distribution of the sand particles 42 about the tube ends 31 is accomplished by blowing air, such as through openings 53, into the region directly above the tube sheet 26 but below the tube inlet ends 30 in order to fluidize the sand or other particulate matter 42. For this purpose, the openings 53 communicate with chamber 51 between the tube sheet 26 and the segmented distribution chamber 50. This fluidizing action tends to evenly distribute the sand 42 which has flowed onto the tube sheet 26 inside of the distribution ring 52. In addition, this fluidizing serves to force the sand particles 42 upwardly off of the tube sheet 26 along the outside surfaces 38 of the tubes 12. In essence, the elevation of the sand or other particulate matter 42 is increased by the blowing of pressurized air into the region between the upper tube sheet and the inlet ends 30 of the tubes 12.

As the sand or other particulate matter 42 is distributed evenly on the upper tube sheet 26 and is directed upwardly along the outside surfaces 38 of the tubes 12, some of the sand particles will reach an elevation at or just above the elevation of the inlet ends 30 of the tubes 12. At this elevation, the sand or other particulate matter 42 will simply flow by gravity into the tube inlet ends 30 over the upper edges 39 of the tubes 12. From there, the sand will fall downwardly along the inner surfaces 40 of the tubes 12 by means of gravity to scour the inside surfaces 40. The hot dirty gases flowing into the inlet chamber 20 and then down through the tubes 12 will force the particulate cleaning media 42 outwardly against the inner walls 40 of the tubes 12 and/or will serve to drag such particles 42 downwardly along the inner walls 40 of the tubes 12. However, because the particulate cleaning matter 42 does not have an opportunity to become entrained in the gas flow, the particulate cleaning matter 42 will not flow at the high velocity of the gas through the tubes 12, but instead will flow under the influence of gravity and the drag forces exerted by the gases flowing through the tubes 12. As a result of the fact that the particles 42 do not move at such a relatively high velocity, erosion of the inner tube surfaces 40 will not occur; rather, an efficient cleaning will result.

Figure 4:
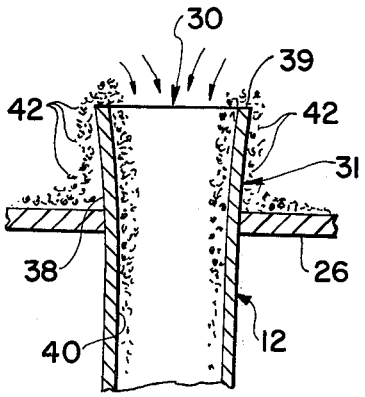
FIG. 4 is an enlarged side sectional view of a tube supported by the tube sheet and illustrating the flow of particulate cleaning media upwardly along the exterior surface of the tube and into the tube, with same being directed against the inner walls of the tube as it then flows downwardly through the tube.

Preferably, the inlet ends 30 for the tubes 12 are flared outwardly to assume a bell mouthed configuration. This is shown best in FIG. 4. This configuration is advantageous for insuring that the particulate cleaning matter 42 is directed onto the inner surfaces 40 of the tubes 12 as it is introduced into the tubes 12. As the particulate cleaning matter reaches the height of the tube inlet ends 30, and flows onto the flared portion of the tubes 12 and is directed inwardly towards the interior of the tubes 12, the gas flow impinging at the inlet ends 30 will force the particles 42 against the inner side walls 40 of the tubes 12. In essence, as the particles flow over the upper edges 39 of the tubes 12 into the tubes 12, they fall onto the inner surface 40 and tend to adhere to that surface 40 as they fall by gravity or are dragged along by the influence of the gas flow through the tubes 12.

Upon exiting from the tubes 12 in the outlet chamber 24, the gas flow is turned and directed upwardly through the outlet conduit 18 where it is then conducted to air pollution control equipment and the exhaust fan (not shown). A gravitational inertia separator 56 is placed in the outlet chamber 24 as shown schematically in FIG. 1 to separate the particulate cleaning matter 42 from the cooled dirty gases and for directing such particulate cleaning matter 42 downwardly to the bottom of the outlet chamber 24. From there, the separated particulate matter is conducted through appropriate pipes or chutes 58 to a particulate cleaning media storage container 60. The particulate cleaning media storage container 60 feeds the particulate cleaning media 42 into the pneumatic lift system 62 which serves to supply the particulate matter 42 to the external distribution chamber 46 as described hereinabove. Thus, after cleaning, the particulate cleaning media 42 is separated from the cooled gases and is recycled for use to clean the inside surfaces 40 of the tubes 12 again.

The gravitational inertia separator 56 placed in the outlet chamber 24 may be of any of the conventional types, as are well known in the art, for separating particulate matter which has become entrained in the gas flow. Such entrainment may occur as the particulate cleaning matter 42 moves downwardly through tubes 12 and/or as a result of falling in the relatively open outlet chamber 24 where it has an opportunity to become entrained as the gas flow turns and is conducted upwardly through the outlet conduit 18 to the air pollution control equipment. The particles which do not become entrained also fall downwardly to the lower end of the outlet chamber 24 and thus to the media storage container 60.

Thus, it is seen that the present invention provides an efficient means and method for cleaning of the inside surfaces 40 of the tubes 12 of a shell-tube type heat exchanger 10 without deleteriously affecting the surfaces 40 of the tubes 12, etc. By first introducing and distributing particulate cleaning matter 42, such as sand, onto the upper surface of the tube sheet 26 below the inlet ends 30 of the tubes 12 through which the hot dirty gases flow and then forcing such particulate cleaning matter 42 in a direction counter to the flow of the gases to the inlet ends 30 of the tubes 12, the particulate cleaning media 42 does not become entrained in the gas flow but rather simply flows downwardly along the inner surfaces 40 of the tubes 12, either by gravity and/or drag forces exerted by the gas flow. As such, the particulate cleaning matter 42 serves to efficiently and effectively clean the inner surfaces 40 of the tubes 12, but not with such an abrasive quality as to cause the tubes to wear out or through.

As such cleaning of the tubes 12 is efficient, it may not be necessary to operate the cleaning system on a continuous basis during operation of the industrial plant or other apparatus in which the heat exchanger 10 is placed. Instead, it may be sufficient to only run such cleaning system during a portion of the operation of the heat exchanger 10, such as for example five minutes of every hour. In such instances, it is not necessary to remove all particulate cleaning media 42 from the inlet chamber 20. Rather, the fluidizing air which is injected into the bed of particulate matter 42 on the surface of the tube sheet 26 may simply be turned off and the pneumatic lifting of the particulate cleaning matter 42 stopped. Then, the particulate matter 42 will simply settle in the tube sheet 26 below the inlet ends 30 of the tubes 12 ready for a subsequent cleaning of the tubes 12 as soon as the fluidizing air is activated.

It is to be noted that only a single pump or blower 63 is necessary for both lifting of the sand and fluidizing the bed of particulate matter 42 on the surface of the upper tube sheet 26. The single blower 63 could include appropriate ducting for conducting the air to both the piping 44 for lifting or conveying of the particulate matter 42 upwardly, and into the inlet chamber 20 through chamber 51 and openings 53 for fluidizing the bed of particulate matter 42. The single blower 63 could thus fluidize the bed of particulate matter 42 on the tube sheet 26 while at the same time particulate matter is delivered to the external distribution chamber 46. It is to be noted that it is necessary to fluidize the bed of particulate matter 42 on the tube sheet 26 and to also deliver sand to the distribution chamber only when it is desired to perform a cleaning operation on the tubes 12. Otherwise, the blower 63 may simply be turned off.

Alternatively, if cleaning of the tubes 12 of the heat exchanger 10 is done on a regular intermittent basis and if the distribution chamber 46 is chosen to be of a suitable size, the single blower 63 may serve to deliver all of the sand necessary for the cleaning operation to the distribution chamber 46 from where it then falls downwardly into the segmented inner distribution chamber 50 and onto the tube sheet 26. By means of a flip-flop mechanism (not shown), the air conducted from the blower can then be directed to fluidize the bed of particulate matter 42 to perform the cleaning operation as previously described. After the fluidized particulate matter 42 has been introduced into the inlet ends 30 of the tubes 12, the blower 63 can be stopped until the next intermittent cleaning operation is to be performed. At that time, the blower 63 can be turned on and sand lifted to the external distribution chamber 46 above the heat exchanger 10 from where the cleaning operation cycle can be repeated.

It is to be noted that in the preferred embodiment, the tubes 12 are arranged vertically within the heat exchanger 10 in order to take advantage of the gravity forces on the particulate cleaning matter 42 to evenly clean the entire inner surfaces 40 of the tubes 12 with the method and apparatus of the present invention. That is, by having the tubes 12 arranged vertically, the particulate cleaning matter 42 falls by gravity into the inlet ends 30 of the tubes 12 and moves downwardly along the tubes by the force of gravity, which results in a complete and efficient cleaning of the inner tube surfaces 40. However, it is contemplated that the present invention can also be utilized where the tubes 12 are not arranged vertically but are included at an angle, or even where the outlet ends are located above the inlet ends. In such operations, the full advantage of gravity influence on the particulate cleaning matter 42 will not be able to be taken advantage of, but instead the cleaning will be dependent on the particles 42 being dragged along the tube surfaces 40 by the gas flow. It is to be noted though that in such instances, the particles dragged by the gases are not entrained in the gases and therefore do not move at the high velocity of such gases.

Thus, it is seen that the present invention provides an improved method for providing continuous cleaning of the heat exchanger 10 of the shell-tube type. In such a heat exchanger 10 in which the tubes 12 extend into a gas inlet chamber 20 beyond the tube sheet 26, particulate cleaning matter 42, in the form of sand, steel shot, limestone, etc., is introduced between the tube inlet ends 30 and the tube sheet 26, and is forced along the exterior surfaces 38 of the tubes 12 to the tube inlet ends 30 in a direction counter to the directional flow of the gases through the tubes 12. From there, the particulate cleaning matter 42 is introduced into the tubes 12 and flows therealong in the direction of the gas flow to efficiently clean the inner surfaces 40 of the tubes 12 without eroding such tube surfaces. According to the apparatus of the present invention, means are provided for introducing and distributing the sand or other particulate cleaning media 42 between the tube sheet 26 and the tube inlet ends 30, and for forcing such particulate cleaning media 42 along the exterior surfaces 38 of the tubes 12 through the inlet ends 30 of the tubes 12 in a direction counter to the flow of the gases through the tubes 12.

While the preferred embodiment of the present invention has been shown and described, it will be understood that such is merely illustrative and that changes may be made without departing from the scope of the invention as claimed.

What is claimed is:

1. A method of cleaning a heat exchanger during operation thereof, the heat exchanger having a plurality of tubes each of which has an inlet end and an outlet end, and through which a first fluid is conducted from said inlet end to said outlet end in indirect heat transfer relationship with a second medium disposed on the outside of said tubes intermediate the inlet and outlet ends of said tubes, the heat exchanger further including an inlet chamber for said first fluid, a tube sheet for supporting the inlet ends of said tubes and isolating the inlet chamber for said first fluid from said second medium, the inlet ends of said tubes extending into the inlet chamber beyond said tube sheet, the method comprising:

introducing a particulate cleaning media into said inlet chamber between the inlet ends of said tubes and said tube sheet; and forcing said particulate cleaning media along the exterior surfaces of said tubes to the inlet ends of said tubes in a direction counter to the direction of flow of said first fluid through said tubes so that said particulate cleaning matter is introduced into said tubes and is directed against the inner walls of said tubes as the direction of flow of said particulate cleaning matter is changed so that it flows through said tubes in the direction of the flow of said first fluid.

2. The method of cleaning a heat exchanger of claim 1 wherein said inlet ends of said tubes are arranged above the outlet ends of said tubes, and wherein said step of forcing comprises forcing said particulate cleaning media upwardly along the exterior surfaces of said tubes.

3. The method of cleaning a heat exchanger of claim 2 further including the step of evenly distributing the particulate cleaning media onto the surface of said tube sheet below the inlet ends of said tubes prior to the step of forcing said particulate cleaning media upwardly.

4. The method of cleaning a heat exchanger of claim 3 wherein the step of evenly distributing and then forcing said particulate cleaning media upwardly comprises gravity feeding said particulate cleaning media onto a tube sheet and fluidizing said particulate cleaning media fed onto said tube sheet to cause said particulate cleaning media to be distributed evely about said tube sheet and to cause said distributed particulate cleaning media to be directed upwardly to the elevation of said inlet ends of said tubes to allow said particulate cleaning media to flow into said tubes.

5. The method of cleaning a heat exchanger of claim 4 wherein said fluidizing step comprises introducing pressurized air into said particulate cleaning media which has been gravity fed onto the tube sheet.

6. A self cleaning shell-tube type heat exchanger comprising:

a plurality of tubes for conducting a first fluid therethrough in indirect heat transfer relationship with a second exchange media, said tubes each having an inlet end, a heat exchange section along which heat is transferred between said first fluid and said second exchange media, and an outlet end;

an inlet chamber communicating with said inlet ends of said tubes for introducing said first fluid into said tubes;

an outlet chamber communicating with said outlet ends of said tubes for receiving said first fluid after conduction through said tubes;

a tube sheet for said tubes intermediate said inlet ends of said tubes and said heat exchange section of said tubes for supporting said inlet ends of said tubes in said inlet chamber, said inlet ends of said tubes extending into said inlet chamber beyond said tube sheet; and means for distributing particulate cleaning media between the inlet ends of said tubes and said tube sheet in said inlet chamber and for forcing said particulate cleaning media along the exterior surfaces of said tubes to the inlet ends of said tubes in a direction counter to the direction of flow of said fluid through said tubes so that said particulate cleaning media is introduced into said tubes and directed against the inner walls of said tubes as the direction of flow of said particulate cleaning media is changed and said particulate cleaning media is caused to move through said tubes in the direction of flow of said first fluid.

7. The self cleaning heat exchanger of claim 6 wherein said inlet ends of said tubes are at an elevation above said outlet ends of said tubes, wherein said tube sheet is below said inlet ends of said tubes and wherein said means for distributing and forcing said particulate cleaning media upwardly along the exterior surfaces of said tube to said inlet ends of said tubes.

8. The self cleaning heat exchanger of claim 7 wherein said plurality of tubes are arranged vertically with said inlet ends above said outlet ends.

9. The self cleaning heat exchanger of claim 7 wherein said means for distributing and forcing comprises means for forcing said particulate cleaning media to an elevation at or just above said inlet ends of said tubes so that a substantial portion of said particulate cleaning media falls by gravity into said tubes and is directed against the inner surfaces of said tubes.

10. The self cleaning heat exchanger of claim 7 wherein said means for distributing and forcing comprises means for introducing said particulate cleaning media onto said tube sheet below the elevation of said tubes, and fluidizing means for fluidizing said particulate cleaning media and forcing said fluidized particulate cleaning media upwardly along the exterior surfaces of said tubes to the inlet ends of said tubes.

11. The self cleaning heat exchanger of claim 10 wherein said fluidizing means comprises means for injecting fluidizing air into said particulate cleaning media which has been introduced onto said tube sheet.

12. The self cleaning heat exchanger of claim 10 wherein said means for introducing said particulate cleaning media comprises a distribution ring surrounding said plurality of tubes and extending upwardly from said tube sheet to an elevation above the inlet ends of said tubes, said distribution ring having a plurality of distribution openings spaced about the circumference thereof for introducing particulate cleaning media therethrough into the interior of said ring onto said tube sheet.

13. The self cleaning heat exchanger of claim 12 wherein said distribution ring having said distribution openings comprises a ring shaped member having V-shaped openings at the upper edge thereof for said particulate cleaning media to flow therethrough by gravity onto said tube sheet.

14. The self cleaning heat exchanger of claim 7 wherein said inlet ends of said tubes are funnel shaped having an open end of a first diameter tapering to a second diameter corresponding to the inner diameter of said tubes, said second diameter being less than said first diameter so that said particulate cleaning media when introduced into said tubes will be directed against the inner walls of said tubes upon downward movement of said particulate cleaning media through said tubes.

* * * * *